US011220890B2

(12) United States Patent
Xiao

(10) Patent No.: US 11,220,890 B2
(45) **Date of Patent: *Jan. 11, 2022**

(54) INDUCED CAVITATION TO PREVENT SCALING ON WELLBORE PUMPS

(71) Applicant: Saudi Arabian Oil Company, Dhahran (SA)

(72) Inventor: Jinjiang Xiao, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 16/931,908

(22) Filed: Jul. 17, 2020

(65) Prior Publication Data

US 2021/0002985 A1 Jan. 7, 2021

Related U.S. Application Data

(63) Continuation of application No. 15/827,733, filed on Nov. 30, 2017, now Pat. No. 10,731,441.

(60) Provisional application No. 62/434,158, filed on Dec. 14, 2016.

(51) Int. Cl.

| | |
|---|---|
| ***E21B 43/12*** | (2006.01) |
| ***E21B 37/00*** | (2006.01) |
| ***E21B 41/02*** | (2006.01) |
| ***F04D 13/10*** | (2006.01) |
| ***F04D 29/70*** | (2006.01) |

(52) U.S. Cl.

CPC ..... *E21B 41/02* (2013.01); *E21B 37/00* (2013.01); *E21B 43/128* (2013.01); *F04D 13/10* (2013.01); *F04D 29/708* (2013.01); *F05D 2250/51* (2013.01)

(58) Field of Classification Search

CPC ..... E21B 43/128; E21B 37/08

See application file for complete search history.

(56) References Cited

U.S. PATENT DOCUMENTS

| | | | |
|---|---|---|---|
| 6,973,972 | B2 | 12/2005 | Aronstam |
| 7,017,681 | B2 | 3/2006 | Ivannikov et al. |
| 7,762,715 | B2 | 7/2010 | Gordon et al. |
| 8,197,602 | B2 | 6/2012 | Baron |
| 8,261,841 | B2 | 9/2012 | Bailey et al. |
| 8,771,499 | B2 | 7/2014 | McCutchen et al. |

(Continued)

FOREIGN PATENT DOCUMENTS

| | | | |
|---|---|---|---|
| CN | 101328769 | 12/2008 | |
| CN | 101328796 A * | 12/2008 | ..... E21B 37/00 |

(Continued)

OTHER PUBLICATIONS

Communication Pursuant to Article 94(3) in European Appln. No. 17829856.0, dated May 8, 2020, 20 pages.

(Continued)

*Primary Examiner* — Giovanna Wright

(74) *Attorney, Agent, or Firm* — Fish & Richardson P.C.

(57) ABSTRACT

A downhole production assembly includes a downhole pump that can be positioned at a downhole location in a wellbore, and a cavitation chamber located upstream of an inlet of the downhole pump in the wellbore. The cavitation chamber can induce cavitation in a wellbore fluid pumped in the uphole direction by the downhole pump to prevent scaling on the downhole pump.

36 Claims, 3 Drawing Sheets

(56) References Cited

U.S. PATENT DOCUMENTS

| | | | | |
|---|---|---|---|---|
| 8,936,430 | B2 | 1/2015 | Bassett | |
| 10,731,441 | B2 * | 8/2020 | Xiao | E21B 41/02 |
| 2008/0236842 | A1 | 10/2008 | Bhavsar et al. | |
| 2013/0248429 | A1 | 9/2013 | Dahule | |
| 2016/0010451 | A1 | 1/2016 | Melo | |
| 2016/0016834 | A1 | 1/2016 | Dahule | |
| 2016/0024849 | A1 | 1/2016 | Kocis et al. | |
| 2018/0340389 | A1 * | 11/2018 | Wang | E21B 28/00 |

FOREIGN PATENT DOCUMENTS

| | | |
|---|---|---|
| CN | 105239963 | 1/2016 |
| CN | 105422047 | 3/2016 |
| GB | 2166472 | 5/1986 |
| JP | S 57146891 | 9/1982 |
| JP | 2003502155 | 1/2003 |
| JP | 2006510484 | 3/2006 |
| JP | 2014047422 | 3/2014 |
| WO | WO 2006117935 | 11/2006 |
| WO | WO 2014147645 | 9/2014 |

OTHER PUBLICATIONS

Gulf Cooperation Council Examination Report issued in GCC Application No. GC 2017-34427 dated Apr. 21, 2019, 4 pages.

International Search Report and Written Opinion in International Application No. PCT/US2017/064407 dated Mar. 13, 2018, 13 pages.

Champion et al., "SPE-82197: The application of high-power sound waves for wellbore cleaning," SPE Production and Facilities, presented at the SPE European Formation Damage Conference, May 13-14, 2003, 10 pages.

Krag et al., "SPE170898-MS: Preventing Scale Deposition Downhole Using High Frequency Electromagnetic AC Signals from Surface Enhance Production Offshore Denmark," Society of Petroleum Engineers, presented at the SPE Annual Technical Conference and Exhibition, Oct. 27-29, 2014, 10 pages.

laserfocusworld.com' [online], "High-Power Lasers: Fiber lasers drill for oil," Dec. 5, 2012, [retrieved on May 31, 2018], retrieved from URL:<https://www.laserfocusworld.com/articles/print/volume-48/issue-12/world-news/high-power-lasers-fiber-lasers-drill-for-oil.html>, 4 pages.

Muswar et al., "SPE133526-MS: Field Effectiveness of a Physical Water Treatment Device to Control Carbonate Scale in Indonesia," Society of Petioleum Engineers, presented at the SPE Asia Pacific Oil and Gas Conference and Exhibition, Oct. 18-20, 2010, 11 pages.

Rzeznik et al., "Two Year Results of a Breakthrough Physical Water Treating System for the Control of Scale in Oilfield Applications," SPE114072, Copyright 2008, 11 pages.

CN Office Action in Chinese Appln. No. 201780076829.1, dated Mar. 3, 2021, with English Translation, 19 pages.

Wang Bing et al., "Wellbore Scaling and Descaling Research," Oil Field Equipment, Nov. 2007, 36(11): 17-21, English Abstract.

CN Office Action in Chinese Appln. No. 201780076829.1, dated Jun. 10, 2021, with English Translation, 22 pages.

"Ocean Exploration and Resource Development Technology", Editorial Board of Science and Technology Prospering the Sea Series, Ocean Press, Oct. 31, 2001, pp. 79, English Abstract only, 14 pages.

Qin Guozhi et al., "Anti-corrosion Coating Technology and Equipment Application Manual", Sinopec Press, Jun. 30, 2004, pp. 257, English Abstract only, 19 pages.

JP Office Action in Japanese Appln. No. 2019-532065, dated Oct. 8, 2021, 7 pages.

* cited by examiner

INDUCED CAVITATION TO PREVENT SCALING ON WELLBORE PUMPS

CROSS-REFERENCE TO RELATED APPLICATIONS

This application claims priority to U.S. application Ser. No. 15/827,733, entitled "Induced Cavitation To Prevent Scaling On Wellbore Pumps" filed on Nov. 30, 2017, which in turn claims the benefit of priority to U.S. Application Ser. No. 62/434,158 entitled "Induced Cavitation To Prevent Scaling On Wellbore Pumps" filed on Dec. 14, 2016, the entire contents of which are incorporated herein by reference.

TECHNICAL FIELD

This specification relates to producing a wellbore, for example, using assistive devices such as wellbore pumps.

BACKGROUND

In hydrocarbon production, hydrocarbons are produced from a wellbore drilled into a geological formation. At times, the natural pressure of a reservoir is unable to flow hydrocarbons from the wellbore. When this happens, artificial-lift apparatuses and systems, such as electric submersible pumps (ESPs), are often installed in the wellbore.

SUMMARY

This specification describes technologies relating to preventing scale buildup on wellbore pumps.

In a first example implementation, a downhole production assembly includes a downhole pump configured to be positioned at a downhole location in a wellbore. The system includes a cavitation chamber located upstream of an inlet of the downhole pump in the wellbore.

In an aspect combinable with the first example implementation, the cavitation chamber is configured to induce cavitation in a fluid flowed through the downhole pump. The fluid includes scaling products, the cavitation causing the scaling products to precipitate out of the fluid.

In another aspect combinable with any of the other aspects, the cavitation chamber is attached to an inlet of the downhole pump.

In another aspect combinable with any of the other aspects, an interior surface of the cavitation chamber is configured to prevent blockage by the precipitated scaling products.

In another aspect combinable with any of the other aspects, the cavitation chamber includes a chemical coating configured to prevent blockage by the precipitated scaling products.

In another aspect combinable with any of the other aspects, the cavitation chamber includes a mechanical cleaner configured to prevent blockage by the precipitated scaling products.

In another aspect combinable with any of the other aspects, the cavitation chamber includes an ultrasonic cleaner, the ultrasonic cleaner being configured to prevent blockage by the precipitated scaling products.

In another aspect combinable with any of the other aspects, the cavitation chamber includes a rotating cavitator configured to induce the cavitation in the fluid by rotating within the fluid.

In another aspect combinable with any of the other aspects, the rotating cavitator is configured to be coupled to a rotating shaft of the downhole pump.

In another aspect combinable with any of the other aspects, the rotating cavitator is configured to passively free-spin, wherein the fluid flow causes the free-spin.

In another aspect combinable with any of the other aspects, the cavitation chamber includes an ultrasonic transducer configured to induce the cavitation in the fluid by emitting an ultrasonic frequency into the fluid.

In another aspect combinable with any of the other aspects, the ultrasonic transducer is configured to produce frequencies from 40 kHz to 10 MHz.

In another aspect combinable with any of the other aspects, the ultrasonic transducer has a maximum power output of 20 KW.

In another aspect combinable with any of the other aspects, the cavitation chamber includes a laser emitter configured to induce the cavitation in the fluid by emitting a laser into the fluid.

In another aspect combinable with any of the other aspects, the laser emitter emits a pulsed laser.

In another aspect combinable with any of the other aspects, the laser emitter emits a continuous laser.

In another aspect combinable with any of the other aspects, a laser emitter surface includes a surface coating or an ultrasonic transducer, which is configured to prevent adherence of the precipitated scaling products to the laser emitter surface.

In another aspect combinable with any of the other aspects, the cavitation chamber includes an electrical arc emitter.

In another aspect combinable with any of the other aspects, the electric arc emitter is configured to produce an electrical arc in a flow-path of the fluid.

In another aspect combinable with any of the other aspects, the electric arc emitter has a maximum voltage rating of 9000V.

In another aspect combinable with any of the other aspects, the electrical arc emitter is configured to produce a pulsed electric arc.

In another aspect combinable with any of the other aspects, the electrical arc emitter is configured to produce a continuous electric arc.

In another aspect combinable with any of the other aspects, the system includes a power supply system configured to provide power to the cavitation chamber.

In another aspect combinable with any of the other aspects, the power supply system is configured to power the downhole pump.

In a second example implementation, a well fluid is received in a cavitation chamber positioned upstream of a downhole pump inlet of a downhole pump. The well fluid includes scaling products. Cavitation is induced within the well fluid within the cavitation chamber to precipitate the scaling products within the cavitation chamber.

In an aspect combinable with the second example implementation, the cavitation chamber is positioned within a flow-path of the well fluid.

In another aspect combinable with any of the other aspects, the precipitated scaling product is ingested into the downhole pump inlet.

In another aspect combinable with any of the other aspects, the cavitation chamber includes a rotating cavitator. To induce cavitation within the fluid, the rotating cavitator is spun within the cavitation chamber.

In another aspect combinable with any of the other aspects, the rotating cavitator is coupled to a downhole pump shaft of the downhole pump. The downhole pump shaft is rotated to rotate the rotating cavitator.

In another aspect combinable with any of the other aspects, the wellbore fluid flow rotates the rotating cavitator.

In another aspect combinable with any of the other aspects, an ultrasonic transducer is configured to induce cavitation in the fluid.

In another aspect combinable with any of the other aspects, the ultrasonic transducer is configured to produce a soundwave has a frequency of 40 KHz-10 MHz.

In another aspect combinable with any of the other aspects, the ultrasonic transducer has a maximum power rating of 20 KW.

In another aspect combinable with any of the other aspects, a laser emitter is configured to induce cavitation within the fluid by producing a laser beam with the laser emitter.

In another aspect combinable with any of the other aspects, the laser beam is a pulsed laser.

In another aspect combinable with any of the other aspects, the an electrical arc is configured to induce cavitation within the fluid.

In another aspect combinable with any of the other aspects, the electrical arc has a maximum voltage of 9000V.

In a third example implementation, a wellbore producing system includes an electric submersible pump configured to be located within a wellbore. The system includes a cavitation chamber configured to be positioned within a wellbore flow-path upstream of an inlet to the electric submersible pump. The cavitation chamber is configured to induce cavitation in the fluid and precipitate scaling products upstream of the pump.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figures 1A, 1B:
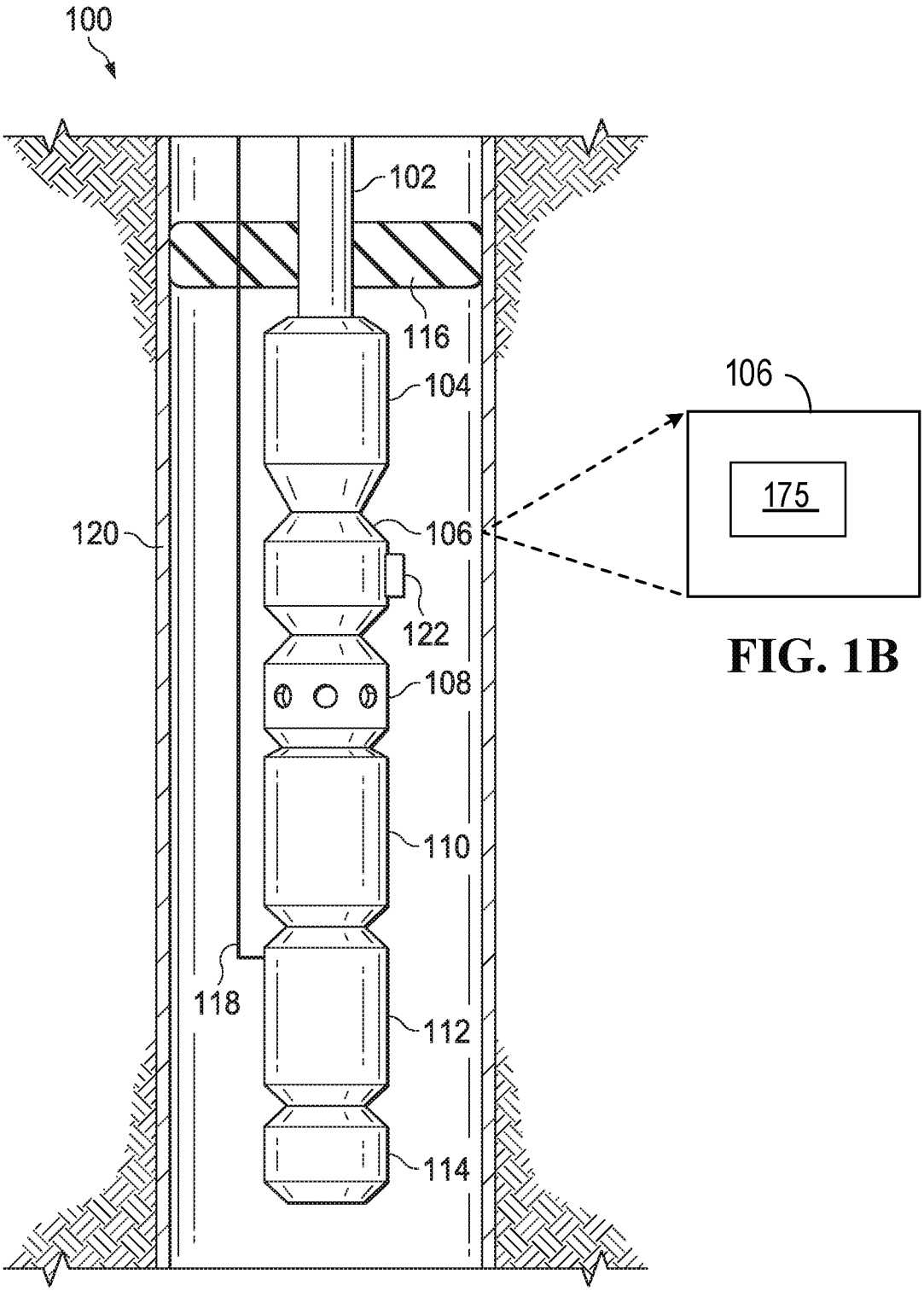
FIG. 1A shows a schematic diagram of an example downhole production assembly.
FIG. 1B shows a schematic diagram of an example downhole production assembly of FIG. 1A, with a cavitation chamber including a mechanical cleaner.

There are downhole scale deposition challenges associated with hydrocarbon production. Scale problems are the result of a three-stage process: nucleation, precipitation, and adherence to equipment. Nucleation can occur when the concentration of the scaling ions exceeds the solubility limit of the mineral scale in the production fluids. Nucleation is the creation of a sub-particle or ion-cluster consisting of several opposite charged scaling ion-pairs. The clusters form either in bulk fluids or on a substrate such as sand grains, clay, metallic surfaces, or other scale crystals. Once formed, the clusters can grow along well defined crystal planes as more ions or more ion-clusters become attached to the growing crystal surfaces. Once the crystal is sufficiently large, it cannot be held in suspension and will fall out of the fluid. Crystals dropping out of fluids, combined with crystals forming and growing on the metallic surface, can lead to scale deposits. Scale growth can continue, gradually removing scaling ions from solutions, until the concentration of the scaling ions falls below saturation.

Production water, which is often produced with hydrocarbons in production fluid, contains dissolved minerals as dissolved ions. Changes in operating conditions such as pressure, temperature, pH value, flow agitation, or flow restrictions can affect the solubility of the dissolved solids. Operating pressure can influence the solubility of calcium carbonate mineral which can form scale as calcite, aragonite and vaterite—different crystal structures with the same chemical composition ($CaCO_3$), especially in the presence of $CO_2$ and $H_2S$ in the production fluids. As pressure falls, $CO_2$ concentration in the production water can decrease due to either $CO_2$ vaporization or migration to the hydrocarbon phases. This increases the pH value of the water, reduces the mineral solubility, and causes thermodynamic equilibrium to shift in favor of carbonate scale formation. The solubility of most minerals such as calcium sulfate ($CaSO_4$), strontium sulfate ($SrSO_4$), and barium sulfate ($BrSO_4$) also decreases with pressure reduction.

In ESP operations, as fluids move past the impellers, localized pressure reduction and cavitation can occur. Such pressure changes can promote scale formation, and can decrease the reliability and run life of the artificial lift systems. During ESP operations, solid precipitation and deposition on and within the ESP string including the motor housing, pump intake, stages (impellers & diffusers), and discharge can occur. The solid compositions can include one or more types of scales, such as $CaCO_3$, $CaSO_4$, $SrSO_4$, or $CaMg(CO_3)_2$, and corrosion products. Deposition of solids can result in an increase in ESP trips (shut downs) due to motor high-temperature, current overload, or both. Electrical shorts can occur in the motor due to scale and corrosion buildup in the pump that can force the motor to work harder and exceed the rated design of the motor. As an adequate flow of produced fluid past the motor is required for cooling, blocking of a pump flow-path or buildup around the outside of the motor of solids, can lead to a rapid internal increase in heat within the motor, insulation breakdown, and an electrical short. Some ESP wellbores cannot restart after a shutdown due to a downhole pump shaft rotation restriction from solid buildup between the shaft and radial bearings. Such a failure results in a long and expensive workover to change out the ESP.

Some techniques to inhibit scaling include injecting scale inhibitors which operate by chemically interfering with either scale nucleation, crystal growth or both. However, continuous chemical injection to treat scale in order to increase ESP reliability and run life can require retrofitting existing ESP wells with such a system incurring a high capital and operational expense. Such a retrofit can also introduce new safety concerns to a production facility.

Cavitation is the formation, growth, and implosion of vapor bubbles in a liquid. Cavitation can be used to facilitate the precipitation and removal of calcium carbonate in the production fluid. In other words, cavitation can cause precipitation, and precipitation lowers the ion saturation of the fluid. By precipitating scaling products and lowering the saturation level of the fluid, precipitation and scaling is reduced downstream.

The present specification discusses integrating a cavitation chamber with a downhole production assembly, specifically, downhole (upstream) of ESP pressure generating stages. Hydrodynamic cavitation can be induced within the production fluid as it flows through the cavitation chamber. The induction of cavitation shifts the thermodynamic equilibrium balance towards scale precipitation. Scale precipitation takes away the scaling ions from the production water. The reduction of the scaling species effectively removes the propensity of water to form ion clusters for growth within the rest of the ESP system, downstream of the cavitation chamber.

Inducing cavitation in a well fluid prior to the well fluid entering the inlet of the pressure-generating stage can precipitate out scaling products early, thereby preventing the scaling products from forming within the pressure-generating stage and reducing efficiency. By preventing scaling, the reliability of the ESP, increase run life of the ESP and reduce intervention cost and production deferral.

FIG. 1A shows a schematic diagram of an example downhole production assembly 100 that can be positioned at a downhole location within a wellbore. FIG. 1B shows a schematic diagram of an example downhole production assembly of FIG. 1A, with a cavitation chamber including a mechanical cleaner. The downhole production assembly 100 includes a production tubing 102, a downhole pump 104 (for example, an ESP or other downhole motor) positioned downhole of the production tubing 102, a cavitation chamber 106 including a mechanical cleaner 175, positioned downhole of (that is, upstream of) the downhole pump 104, a wellbore pump intake 108 located downhole of the cavitation chamber 106, a downhole motor-seal 110 positioned downhole of the wellbore pump intake 108, a downhole motor 112 located downhole of the downhole motor-seal 110, and a set of downhole sensors 114 positioned at the downhole end of the downhole production assembly 100.

In general, a downhole pump (sometimes called a downhole-type pump) is designed and manufactured to operate in a downhole environment. For example, the downhole pump 104 can be sized to fit within a wellbore or ruggedized to withstand the downhole environment (such as pressure, temperature, and other conditions) at different depths in the downhole environment. The downhole pump 104 can also be designed to operate, that is, to pump fluid, when disposed downhole. In some implementations, the downhole pump 104 can be a progressive cavity pump (PCP). In general, rotary cavitation chambers can be implemented for wells with artificial lift systems because the motor that drives the artificial lift systems can also drive the rotary cavitation chambers. In some implementations, the cavitation chamber 106 can be added to wells that do not implement artificial lift systems but suffer from scale deposition or buildup. In such implementations, non-rotary cavitation chambers can be implemented. Examples of rotary and non-rotary type cavitation chambers are described with reference to the figures that follow.

In addition to the components listed prior, a packer 116 can be used to isolate a wellbore annulus upstream of the downhole pump 104. The packer 116 can also be used to provide hanging support for the downhole production assembly 100. A power cable 118 can provide power to the downhole motor 112 from a power supply system (not shown). In some implementations, the power cable 118 can also provide power to the cavitation chamber 106 from the same or a different power supply system. The power supply system (or systems) can be located, for example, at a topside facility or at other location.

Fluid flows into the downhole production assembly 100 from a reservoir downhole of the assembly 100 through the wellbore pump intake 108. From the wellbore pump intake 108, the wellbore fluid flows through a cavitation chamber 106 and into a downhole pump 104. The downhole pump 104 sends the wellbore fluid flow in an uphole direction, for example, to a topside facility, via the production tubing 102. The downhole motor 112 rotates the downhole pump 104. The power line 118 provides power to the downhole motor 112. The motor-seal 110 protects the downhole motor 112 by preventing the production fluid from entering the downhole motor 112. The wellbore fluid flowing over the surface of the downhole motor 112 cools the downhole motor 112 during operation of the downhole production assembly 100. The set of downhole sensors 114 relays information about the downhole motor 112 (for example, the ESP system) and the well fluid to the topside facility in real time. Sensor cables can be integrated into power line 118.

The power line 118 (or a different power line (not shown)) can provide power to the cavitation chamber 106, which induces cavitation in the wellbore fluid flowed into the cavitation chamber 106. The induced cavitation precipitates scaling products in the wellbore fluid before the wellbore fluid enters the downhole pump 104. Without the cavitation chamber 106, the scaling products can flow downstream into the downhole pump 104 and decrease the reliability and run life of the downhole pump 104, as described above. The cavitation chamber 106 induces cavitation before the downhole pump 104 inlet.

The cavitation can be confined to the cavitation chamber 106. That is, all gas bubbles that are produced in the cavitation chamber 106 collapse before reaching the inlet of the downhole pump 104. Because cavitation bubbles are generated in very localized areas within the cavitation chamber 106 and short-lived due to high bulk fluid pressure which is higher than the fluid bubble point pressure, the cavitation bubbles collapse quickly. The cavitation chamber 106 and the components within it can be made of any material or materials that are resistant to cavitation damage, such as stainless steel.

The cavitation chamber 106 and the components within can also be coated with a special coating, for example, hydrophobic coating or other coating, to prevent scaling products from attaching to either of them. By preventing scaling products from sticking to the surfaces of the cavitation chamber 106, buildup of scaling products within the cavitation chamber 106 to create a blockage within downhole production assembly 100 can be minimized or avoided. In some implementations, the cavitation chamber 106 can include ultrasonic transducers 122 capable of cleaning surfaces within the cavitation chamber 106 to prevent scale buildup.

The precipitated scaling products are suspended in the well fluid and pass through the downhole pump 104 to the topside facility. The topside facility can be equipped to handle the solids produced by the wellbore. The cavitation chamber 106 precipitates scaling particulates small enough to be easily ingested by the inlet to the downhole pump 104. The particle size is a function of flow velocity, cavitation intensity, and level of fluid saturation. As such, the cavitation chamber 106 is designed to precipitate particles of a certain size range that can be ingested by the pump 104 inlet.

Figure 2:
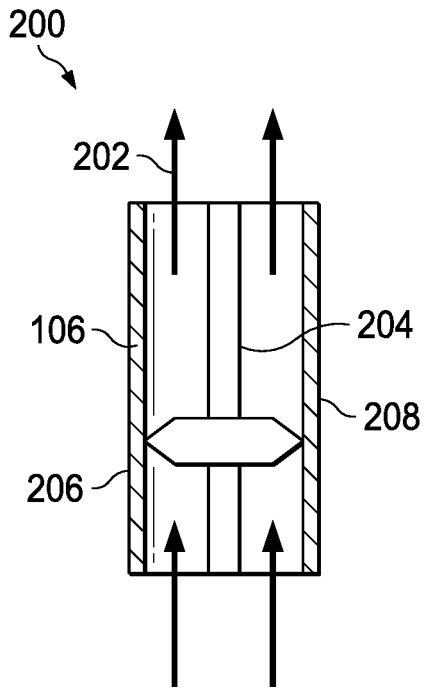
FIG. 2 shows a schematic diagram of an example cavitation chamber with a rotating cavitator.

FIG. 2 shows a schematic diagram of s a rotating cavitator assembly 200 that can be utilized in the downhole production assembly 100. The rotating cavitator assembly 200, which can be placed within the cavitation chamber 106, includes a rotating cavitator 206 centrally located in the cavitation chamber 106 and attached to a rotatable shaft 204. Production fluid 202 flows past through the cavitation chamber 106 and over the rotating cavitator 206, which induces cavitation as it rotates transverse to the fluid flow path 200. The rotating cavitator 206 creates a localized pressure drop during rotation that results in cavitation. Precipitation of scaling products occurs due to the pressure drop where micron-size bubbles form and grow due to the low pressure areas in the fluid flow path. In some implementations, the rotating cavitator 206 passively free-spins. In other words, the fluid flow 200 induces rotation of the rotating cavitator 206. In some implementations, the rotating cavitator 206 is coupled to a rotating motor or pump shaft and is rotated by either the downhole pump 104 or the downhole motor 112. In some implementations a stationary cavitator can be used. A stationary cavitator induces cavitation by creating a pressure drop as the production fluid 202 flows across the surface of the stationary cavitator to produce cavitation in the fluid. Examples of stationary cavitators can include orifice-type, nozzle-type or Venturi-type cavitators. The special coating 208 prevents scale build-up on the inner walls of the cavitation chamber 106. The special coating can include non-stick material or hydrophobic material, for example, polytratafluoroethylene (Teflon™) or other non-stick or hydrophobic material.

Figure 3:
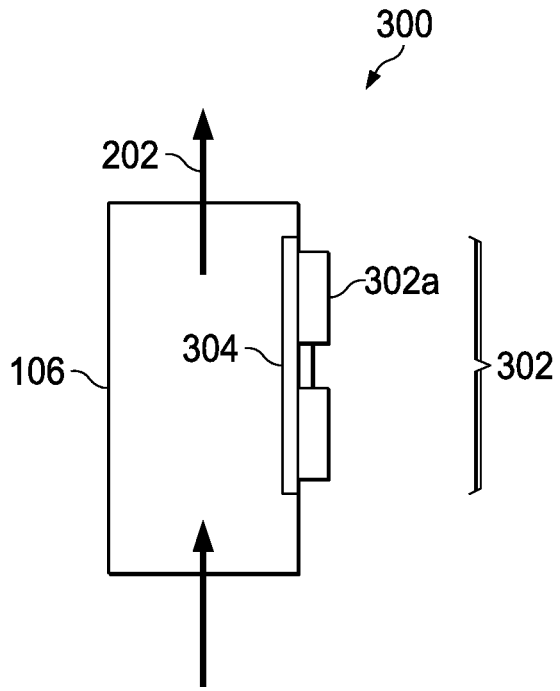
FIG. 3 shows a schematic diagram of an example cavitation chamber with transducers.

FIG. 3 shows a schematic diagram of a transducer assembly 300 that can be utilized in the downhole production assembly 100. The transducer assembly 300 includes a group of transducers 302 attached to a wall of the cavitation chamber 106. The group of transducers 302 induces cavitation in the production fluid 202. In some implementations, the group of transducers 302 can be powered by the power cable 118. For example, the group of transducers 302 can induce ultrasonics-based cavitation as described later. The group of transducers 302 are more powerful than the ultrasonic transducers 122 that are used for cleaning the cavitation chamber 106. In some implementations, the group of transducers 302 can be used for ultrasonic cleaning or the ultrasonic transducers 122 can be used for cavitation.

Soundwaves are vibrations that propagate as mechanical waves of pressure and displacement through materials (gas, liquid, and solid). Ultrasound is a sound with a frequency higher than 20 KHz, beyond the typical human audible range. There are two components within any ultrasound device: an electrical pulse generator and a transducer, such as transducer 302*a*. The pulse generator produces the electrical pulses that are applied to the transducer 302*a*. The pulse generator (not shown) can be located downhole or at the topside facility. In some implementations, the group of transducers 302 can be powered by power line 118. The group of transducers 302 can have one or more piezoelectric elements or other sound producing elements. When an electrical pulse from the pulse generator is applied to the piezoelectric element, the piezoelectric element vibrates and produces an ultrasonic wave. The size of the electrical pulses can change the intensity and energy of the ultrasonic wave. The ultrasonic waves create the ultrasonic cavitation where micron-size bubbles form and grow due to alternating positive and negative pressure waves in the fluid. In some implementations, the power required to sufficiently cavitate the fluid flow 202 can be up to 20 KW. Different ultrasonic frequencies can affect the depth of penetration (into various scale products) and can have different impact on size and type of scales. Some applications require a particular frequency, and others require multiple or a range of frequencies. Such a frequency range can be achieved by the use of the group of transducers 302 in the device or one transducer 302*a* capable of producing different frequencies through the electrical pulses applied to it. For example, in some implementations, sound frequencies that are known to cause cavitation and cleaning, from 40 KHz to 10 MHz, can be used.

On the cavitation chamber 106, the group of transducers 302 is mounted (for example, welded or epoxied) to a radiating diaphragm 304 which is on the walls of the cavitation chamber 106. The displacement in the group of transducers 302, as electrical pulses are applied, causes a movement of the diaphragm 304, which in turn causes pressure waves to be transmitted through the production fluid flow 202 within the cavitation chamber 106. The pressure waves create the ultrasonic cavitation where micron-size bubbles form and grow due to alternating positive and negative pressure waves in the fluids.

Figure 4:
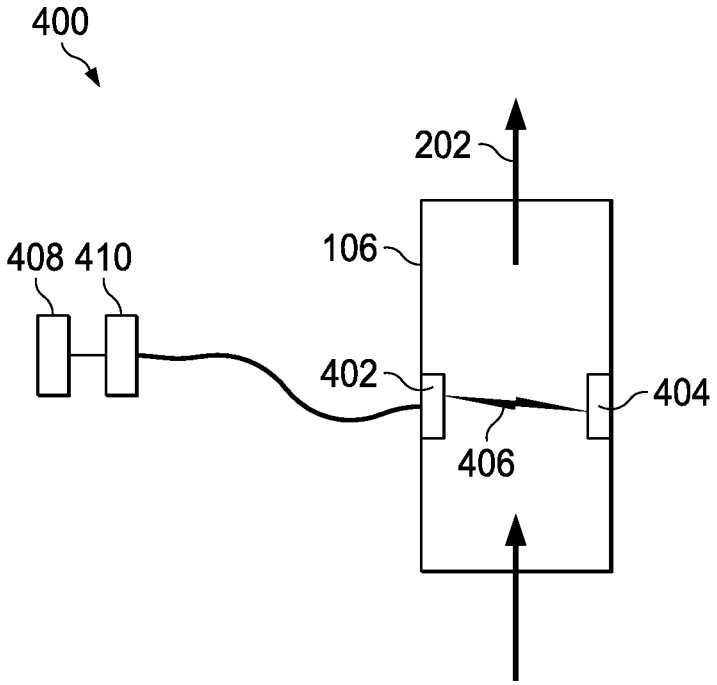
FIG. 4 shows a schematic diagram of an example cavitation chamber with electrodes.

FIG. 4 shows a schematic diagram of an electrode assembly 400 installed within the cavitation chamber 106. that can be utilized in a downhole production assembly 100. The electrode assembly 400 includes a positive electrode 402 and a negative electrode 404. The electrodes can create an electrical arc 406 capable of inducing cavitation in the fluid flow 202. In some implementations, the electrode assembly 400 can be powered by power cable 118.

The cavitation chamber 106 of FIG. 4 implements a process called electrohydraulic cavitation. The electrode assembly 400 creates a high-voltage electrical discharge, such as electrical arc 406, between electrical arc emitters, such as the positive electrode 402 and the negative electrode 404 immersed in the fluid flow 202, to create plasma gas bubbles in the fluid flow 202. The gas bubbles continue to expand until their diameters increase beyond the limit sustainable by surface tension, and at which point the gas bubbles rapidly collapse, producing a shock wave that propagates through the fluid. The shock wave, in the form of a pressure step function, generates high-power ultrasound, which, in turn, can create secondary cavitation.

Both the primary (electrohydraulic) and secondary (ultrasonic) cavitation can enhance scale precipitation. In some implementations, a capacitor 408 is charged to high voltage and a discharge circuit 410 is activated with an oscillating switch (not shown). The capacitor and switch can be located either downhole or at the topside facility. In some implementations, a continuous charge can be used instead of a pulsed charge to produce a continuous electrical arc. In some implementations, a potential difference between the positive electrode 402 and the negative electrode 404 may be up to 9000 volts to produce cavitation. The positive electrode 402 and negative electrode 404 can have various geometries. For example, the positive electrode 402 and negative electrode 404 can be positioned on either side of the flow of the production fluid 202 to produce the electrical arc 406 across (that is, substantially perpendicular to) a direction of the fluid flow 202. Alternatively, the positive electrode 402 and the negative electrode 404 can be positioned on the same side of the flow of the production fluid 202 to produce the electrical arc 406 substantially parallel to the direction of the fluid flow 202.

Figure 5A:
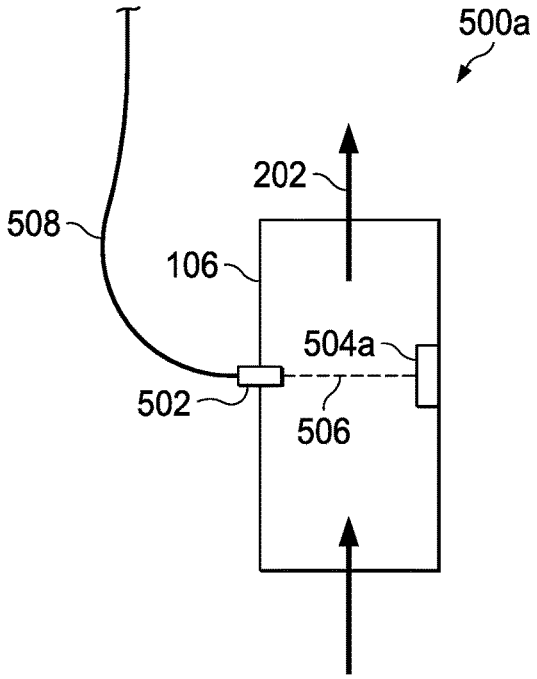
FIGS. 5A and 5B show schematic diagrams of example cavitation chambers with laser emitters.

FIG. 5A shows a schematic diagram of a laser assembly 500*a* installed within cavitation chamber 106 that can be utilized in a downhole production assembly 100. The laser assembly 500 includes a laser emitter 502. The laser emitter 502 emits a laser beam 506 that is directed downhole from the topside facility through a fiber optic cable 508. The laser beam 506 induces cavitation in the fluid flow 202. The laser beam 506 creates plasma gas bubbles in the fluid flow 202. The gas bubbles will continue to expand until their diameters increase beyond the limit sustainable by surface tension, and at which point they will the gas bubbles rapidly collapse, producing a shock wave that propagates through the fluid. The shock wave, in the form of a pressure step function, has the potential to generates high high-power ultrasound, which, in turn. The ultrasound can create secondary cavitation. In some implementations, the laser can be produced downhole by the laser emitter 502. In such implementations, the power cable 118 can be used power the laser emitter 502.

Figure 5B:
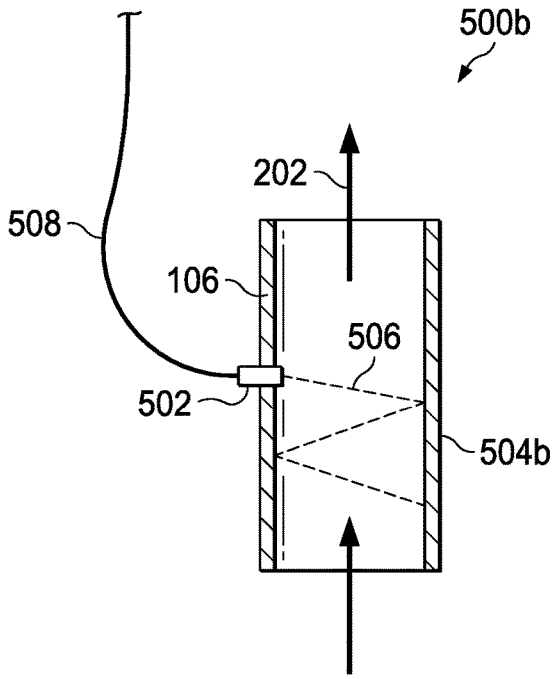

Laser-induced bubbles are generated by the optical breakdown in the bulk of the liquid as the laser beam 506 is focused into liquid. In the illustrated implementation, the laser beam 506 is delivered downhole from a topside facility through the fiber optical cable 508. When introduced into the cavitation chamber 106, the laser beam 506 can radiate through the fluids. In other implementations, such as the alternative laser assembly 500*b* shown in FIG. 5B, reflectors or a reflective coating 504 can be used to trap the beam inside the chamber 106 for more thorough cavitation. The laser beam 506 can be either a pulsed or continuous laser and has a wavelength such that energy is absorbed by the fluid in the form of heat. The laser emitter 502 surface can be equipped with either a chemical coating, an ultrasonic cleaner, or both to prevent scale buildup on the emitter.

Figure 6:
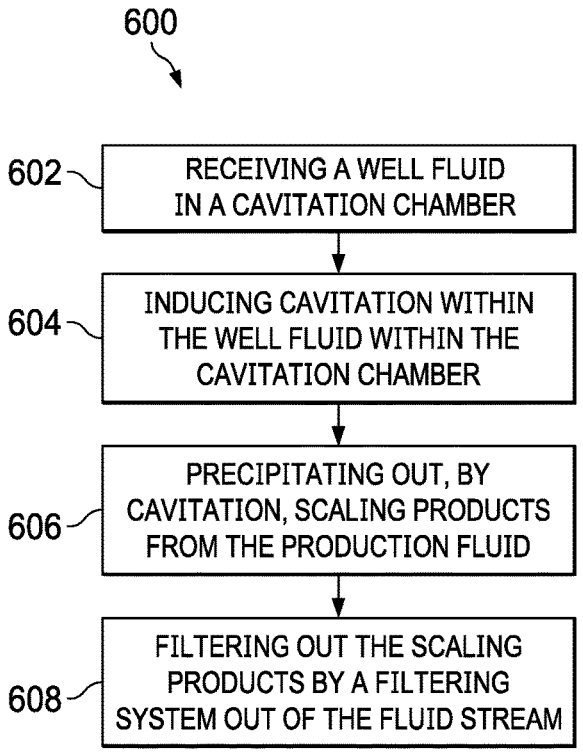
FIG. 6 shows a flowchart of an example method for causing downhole cavitation in upstream of a downhole pump inlet.

FIG. 6 shows a flowchart of an example of a process 600 for utilizing the downhole production system 100. The downhole production system 100 includes a cavitation chamber 106 that is positioned in a flow-path of a well fluid. At 602, a wellbore fluid is received into a cavitation chamber 106. At 604 cavitation is induced within the well fluid within the cavitation chamber 106. At 606, the cavitation causes scaling products to precipitate out of the production fluid. The precipitate scale is ingested by the inlet of downhole pump 104. At 608, the scaling products are filtered out of the fluid stream 202 by a filtering system located either at a topside processing facility.

Thus, particular implementations of the subject matter have been described. Other implementations are within the scope of the following claims. For example, example implementations describe one type of cavitation chamber. In some implementations, different types of cavitation chambers disclosed here can be used in any combination.

The invention claimed is:

1. A downhole production assembly comprising:

a downhole pump configured to be positioned at a downhole location in a wellbore; and a cavitation chamber located upstream of an inlet of the downhole pump in the wellbore, wherein the cavitation chamber comprises a rotating cavitator configured to induce the cavitation in the fluid by rotating within the fluid.

2. The downhole production assembly of claim 1, wherein the cavitation chamber is configured to induce cavitation in a fluid flowed through the downhole pump, the cavitation causing scaling products in the fluid to precipitate out of the fluid.

3. The downhole production assembly of claim 1, wherein the cavitation chamber is attached to an inlet of the downhole pump.

4. The downhole production assembly of claim 2, wherein an interior surface of the cavitation chamber is configured to prevent blockage by the precipitated scaling products.

5. The downhole production assembly of claim 2, wherein the cavitation chamber comprises a chemical coating, the chemical coating being configured to prevent blockage by the precipitated scaling products.

6. The downhole production assembly of claim 2, wherein the cavitation chamber comprises an ultrasonic cleaner, the ultrasonic cleaner being configured to prevent blockage by the precipitated scaling products.

7. The downhole production assembly of claim 1, wherein the rotating cavitator is configured to be coupled to a rotating shaft of the downhole pump.

8. The downhole production assembly of claim 1, wherein the rotating cavitator is configured to passively free-spin, wherein the fluid flow causes the free-spin.

9. The downhole production assembly of claim 1, wherein the cavitation chamber comprises an ultrasonic transducer configured to induce the cavitation in the fluid by emitting an ultrasonic frequency into the fluid.

10. The downhole production assembly of claim 9, wherein the ultrasonic transducer is configured to produce frequencies from 40 kHz to 10 MHz.

11. The downhole production assembly of claim 9, wherein the ultrasonic transducer has a maximum power output of 20 KW.

12. The downhole production assembly of claim 1, wherein the cavitation chamber comprises a laser emitter configured to induce the cavitation in the fluid by emitting a laser into the fluid.

13. The downhole production assembly of claim 12, wherein the laser emitter emits a pulsed laser.

14. The downhole production assembly of claim 12, wherein the laser emitter emits a continuous laser.

15. The downhole production assembly of claim 12, wherein a laser emitter surface comprises a surface coating or an ultrasonic transducer, the surface coating or the ultrasonic transducer configured to prevent adherence of the precipitated scaling products to the laser emitter surface.

16. The downhole production assembly of claim 1, wherein the cavitation chamber comprises an electrical arc emitter.

17. The downhole production assembly of claim 16, wherein the electric arc emitter is configured to produce an electrical arc in a flow-path of the fluid.

18. The downhole production assembly of claim 16, wherein the electric arc emitter has a maximum voltage rating of 9000V.

19. The downhole production assembly of claim 16, wherein the electrical arc emitter is configured to produce a pulsed electric arc.

20. The downhole production assembly of claim 16, wherein the electrical arc emitter is configured to produce a continuous electric arc.

21. The downhole production assembly of claim 1, further comprising a power supply system configured to provide power to the cavitation chamber.

22. The downhole production system of claim 21, wherein the power supply system is configured to power the downhole pump.

23. A method comprising:

receiving a well fluid in a cavitation chamber positioned upstream of a downhole pump inlet of a downhole pump, the well fluid comprising scaling products;

inducing cavitation within the well fluid within the cavitation chamber to precipitate the scaling products within the cavitation chamber, wherein an ultrasonic transducer is configured to induce cavitation in the fluid; and flowing the well fluid from which the scaling products have been precipitated in a downstream direction toward the downhole pump inlet.

24. The method of claim 23, further comprising positioning the cavitation chamber within a flow-path of the well fluid.

25. The method of any of claim 23, further comprising ingesting the precipitated scaling product into the downhole pump inlet.

26. The method of claim 23, wherein the cavitation chamber comprises a rotating cavitator, and wherein inducing cavitation within the fluid comprises spinning the rotating cavitator within the cavitation chamber.

27. The method of claim 23, further comprising:

coupling the rotating cavitator to a downhole pump shaft of the downhole pump; and rotating the downhole pump shaft to rotate the rotating cavitator.

28. The method of claim 23, wherein the wellbore fluid flow rotates the rotating cavitator.

29. The method of claim 23, wherein the ultrasonic transducer is configured to produce a soundwave has a frequency of 40 KHz-10 MHz.

30. The method of claim 23, wherein the ultrasonic transducer has a maximum power rating of 20 KW.

31. The method of claim 23, wherein a laser emitter is configured to induce cavitation within the fluid by producing a laser beam with the laser emitter.

32. The method of claim 31, wherein the laser beam is a pulsed laser.

33. The method of claim 23, wherein an electrical arc is configured to induce cavitation within the fluid.

34. The method of claim 33, wherein the electrical arc has a maximum voltage of 9000V.

35. A wellbore producing system comprising:

an electric submersible pump configured to be located within a wellbore;

a cavitation chamber configured to be positioned within a wellbore flow-path upstream of an inlet to the electric submersible pump, the cavitation chamber configured to induce cavitation in the fluid and precipitate scaling products upstream of the pump, wherein the cavitation chamber comprises an electrical arc emitter; and production tubing configured to be positioned within the wellbore flow-path downstream of the electric submersible pump, the production tubing configured to flow fluid driven by the electric submersible pump in an uphole direction.

36. A wellbore producing system comprising:

production tubing configured to direct a production fluid from a wellbore to a topside facility;

a wellbore pump configured to move the production fluid through the production tubing, the wellbore pump positioned at a downhole end of the production tubing;

a cavitation chamber configured to induce cavitation in the wellbore fluid upstream of the wellbore pump, the cavitation causing scaling products to precipitate out of the fluid before the wellbore fluid enters the wellbore pump, wherein the cavitation chamber comprises an ultrasonic transducer configured to induce the cavitation in the fluid by emitting an ultrasonic frequency into the fluid; and a motor configured to rotate the wellbore pump.

* * * * *